United States Patent [19]

Russell

[11] 4,150,615

[45] Apr. 24, 1979

[54] COMPACTOR-STRAPPER

[76] Inventor: B. Carson Russell, 12821 Marcy St., Omaha, Nebr. 68154

[21] Appl. No.: 807,196

[22] Filed: Jun. 16, 1977

[51] Int. Cl.[2] ..... B65B 13/04

[52] U.S. Cl. ..... 100/7; 100/3; 100/4; 100/26; 100/218; 100/233; 100/236; 100/269 R; 100/295

[58] Field of Search ..... 100/295, 233, 3, 26, 100/218, 7, 269 R, 236, 237, 4

[56] References Cited

U.S. PATENT DOCUMENTS

| | | | |
|---|---|---|---|
| 573,971 | 12/1896 | Greene | 100/236 |
| 3,040,654 | 6/1962 | Opie | 100/218 X |
| 3,939,762 | 2/1976 | Smitherman | 100/3 X |

FOREIGN PATENT DOCUMENTS

| | | | |
|---|---|---|---|
| 551574 | 6/1932 | Fed. Rep. of Germany | 100/233 |

*Primary Examiner*—Billy J. Wilhite
*Attorney, Agent, or Firm*—Hiram A. Sturges

[57] ABSTRACT

A compactor-strapper comprising spaced forward and rearward fixed jaws, forward and rearward moveable jaws, hingedly attached independent actuators for said forward and rearward jaws, said jaws having removeable and replaceable insert members providing cavities forming a work reception chamber, and a strapping machine having a strap applying portion arranged around a strapping space defined by said cavities and between said forward and rearward jaws, and pneumatic circuitry with automatic cycling, controlling said jaws, said strapper, and a bundle ejector, resultant from a single manual control motion.

5 Claims, 4 Drawing Figures

COMPACTOR-STRAPPER

BACKGROUND OF THE INVENTION

A particular problem has existed in the compacting of bundles of firewood. Since firewood is made by splitting logs endwise each log has a much different shape and can have a different volume at one end than at another.

For this reason a compacted bundle of logs will be smaller at one end than at another in most cases. However, the firewood compactors of the past have had fixed and moveable jaws adapted to extend the length of a bundle of firewood, but in which the compartment resultant from the closing of the fixed and moveable jaws with respect to each other against the firewood has the same cross-sectional area on forward and rearward parts thereof whereby one end of a bundle of firewood has been compacted to a lesser extent than the other to the end that a certain amount of looseness is undesirably present.

Firewood compactors of the past have had a place for application of a strap disposed between forward and rearward pairs of jaws, each pair of having a fixed jaw and a moveable jaw. However, when a strap is applied to a bundle as tightly as possible, there is yet an undesirable looseness in many cases because the ends of a bundle of firewood were not completely compacted because of the rigid connection of forward and rearward moveable jaw elements, which latter gave no possibility to adjusting to bundles of firewood having a lesser cross-sectional size at one end of the bundle than the other.

It is an object of this invention to solve this problem by eliminating the use of a single pressure cylinder for operating both forward and rearward moveable jaw elements as has been the characteristic of prior art machines, and further to replace this with the concept of independent actuators, independent pressure cylinders arranged for controlling the moveable jaws so that a rearward moveable jaw element can compact tightly down against a bundle of firewood as far as the firewood will allow the compaction to proceed within the pressure limits of the machine, the forward moveable jaw element being able to likewise compact the firewood to the pressure limit of the machine so that uneven firewood bundles are completely compacted to the desired extent at both the forward and rearward ends of a bundle.

It is a particular object to make possible the tight application of a strap to the center of an uneven bundle of firewood because of this concept of independent actuation of forward and rearward moveable jaw elements.

Firewood compactors of the prior have had moveable jaws which move vertically toward fixed jaws without the moveable jaws having any connection to the frame except through the pressure cylinder assembly.

It is an object of this invention to connect the moveable jaw elements hingedly to the frame at one side of the firewood receiving cavity thereof, and to so position the pressure cylinders that they cause a hinging by exerting a pressure to force the other side of the moveable jaws downwardly for compounding the available pressure at the cylinder assemblies with the great leverage achieved by having one side of the moveable jaws hingedly attached to the frame. In this way an eight inch cylinder expansion can cause a four inch compression at the center of my moveable jaw cavity for compounding the pressure to insure that the bundle of firewood is strapped so very tightly as to be much more likely to stay together during the rough handling and throwing involved in firewood shipment.

Compacting and strapping machines of the prior art have been useful for only making a bundle of a specific size.

Another object of this invention is to provide insert plates having a cavity therein for forming the effective ultimate jaw cavity of the moveable jaws and with the insert plates being removeable and replaceable so that a plate of lesser or greater size can be used for varying the size of the firewood receiving chamber so that the same machine can be used for compacting larger or smaller firewood bundles as desired.

A further object of the invention is to eliminate the problems involved in electrical contact points in electrical circuitry of the prior art in which the dirt commonly found on firewood tends to contaminate the area and the electrical contact points, all this being replaced with pressurized air circuitry by this invention, the air intake port being provided with dust filter for dependable operation.

An objective of this invention is to provide automatic cycling. This means that a single pressing of a valve button will cause the automatic occurrence of everything necessary to bring about a jaw closing and a strapping, a jaw opening and a bundle ejection, all in their proper sequence.

Still another objective is to provide a firewood compactor-strapper which has air actuated timing which is automatic and adjustable.

Because logs have knots causing the grain to curve, the splitting of a log from one end will cause the surface of the split side to have a large bump on it. This causes a log to have a greater effective volume in a bundle at the end where the knot protrudes. In using compactors of the prior art it has been necessary to slowly and carefully select logs to be placed in a given bundle so that the ends of the bundle come out even enough to prevent the strapped bundle from being excessively loose, and an objective hereof is to provide independent forward and rearward jaw cylinder actuation so that logs need not be selected but can be thrown into the machine at random and will still emerge tightly bound.

The further object of the invention is to provide pneumatic circuitry for controlling automatic cycling including jaw closing and opening in which the cylinders for closing the jaws are not pneumatic which would provide less power, but hydraulic because of the non-compressability of liquids giving unlimited amounts of power directly proportional to the horsepower input on the hydraulic pump. This is far superior to compressing air at the very high pressures needed to do the same job because the compressing of air is extremely difficult to the point of being impossible with ordinarily available and affordable air compressor facilities.

A further object of the invention is to provide the use of hydraulic cylinders even though the circuitry is pneumatic because of the safety factor. Since highly compressed air is in danger of rupture of lines, a rupture of a hydraulic line, even under great pressure, is all over immediately without much consequence because all pressure is relieved with a minute amount of motion. However, when pneumatic equipment has a ruptured line, then the air shooting out of the rupture moves great distances at high speeds propelled by all of the air compressed back through the entire system, leaving the possibility of the blowing off of fingers of an operator or his eyes being blinded by the compressed air jet.

However, I conceive of a pneumatic system for use with the hydraulic system that would be at very low pressure such as ninety pounds per square inch pressure. For instance, air at fifty pounds or one-hundred-fifty pounds does exactly the same thing. For instance, five pounds would work; one-hundred five pounds with special equipment would work; at over one-hundred thirty pounds, the pumps aren't even made for air compressing, unless they're super expensive, although they will go to four thousand pounds if super expensive.

A particular objective is elimination of electrical circuitry for control of the automatic cycling. Electrical circuitry has the disadvantage that switches become contaminated with dust, moisture, and in some cases even explosive gasses, so that under the rugged conditions in which a machine might be used, it is far superior to have my concept of a pneumatic circuit for automatic control of a compactor strapper.

Another objective of this invention is to provide in the pneumatic control circuit a pneumatic rotary timer or, better yet, an air plunger timer having adjustable plunger speeds for controlling the sequence of the various operations of the compactor and for regulating the timing of each to an ideal. In a rotary timer it is rotating cams that open and close valves, and the only way the timing can be varied, is by changing the rotating speed of a cam nose. There are two ways of initiating the rotary action, one way is electrical and the other way is pneumatic. The electrical revolves a miniature motor and reduction gear, in which latter it is very difficult to change speed. The pneumatic timer ways available on the market are mostly a pair of duo-cylinders which give an overlapping reciprocation which is a mechanism that is also difficult to change the speed of, or in other words, the timing of the occurrence of each sequence of the operation.

SUMMARY

The compactor-strapper hereof comprises: a frame, forward and rearward fixed jaws rigidly attached to said frame, forward and rearward moveable jaws hingedly attached to said frame at one side thereof and moving toward and away from said forward and rearward fixed jaws, respectively, for compaction and release, forward and rearward independent actuators actuating said forward and rearward moveable jaws, respectively, said fixed jaws and said moveable jaws each having cavities therein, said cavities of said front and rear fixed jaws facing said cavities respectively of said front and rear jaws.

This compactor-strapper further comprises said jaws having removeable and replaceable insert portions having said cavities respectively therein whereby the total work reception chamber of said machine is of variable size, said forward and rearward jaws being spaced apart for providing a strapping space disposed completely from side to side around a chamber defined by said cavities, and a strapping machine mounted on said frame and having strap applying portions arranged around said strapping space and applying straps onto materials disposed in said chamber.

DESCRIPTION OF THE PREFERRED EMBODIMENT

Figure 1:
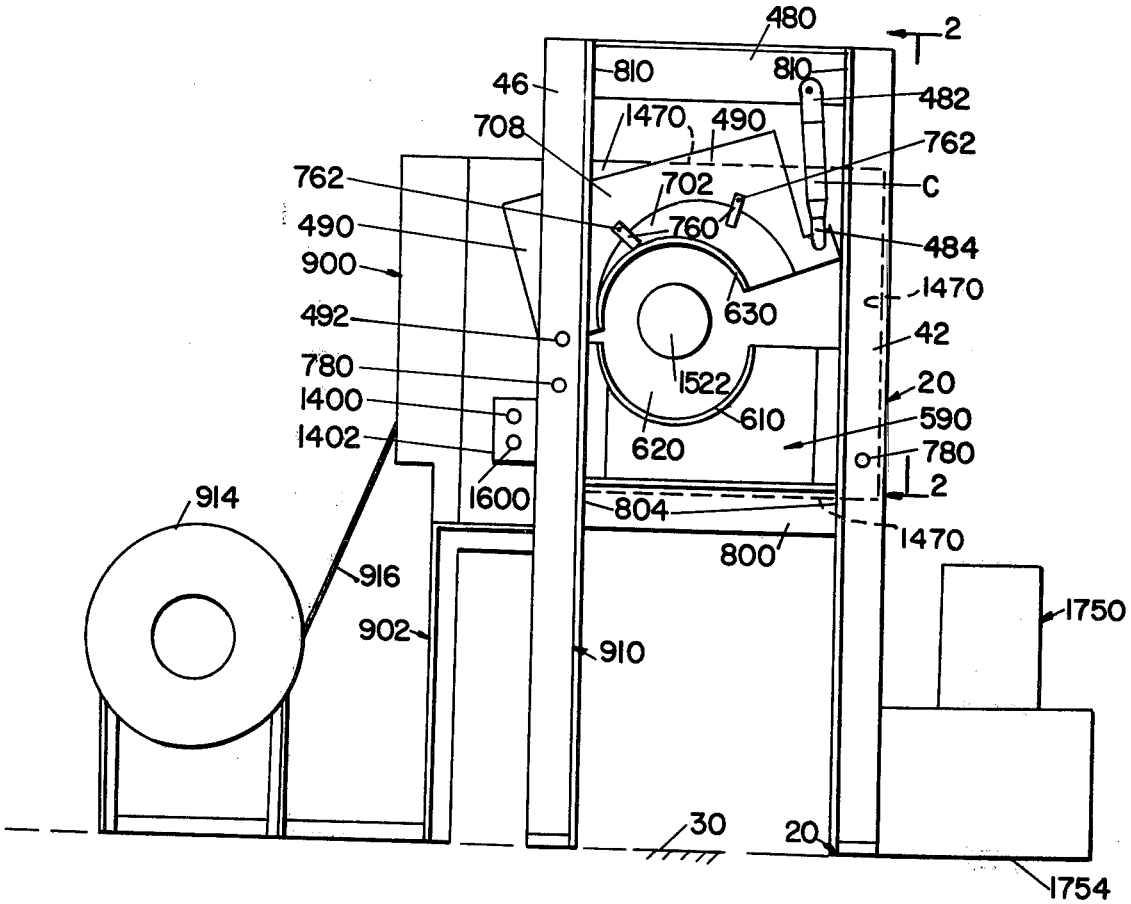
FIG. 1 is a frontal elevation of the compactor-strapper of this invention, shown with the upper jaws in an open position and with an ejection cylinder supporting upwardly extending frame portion omitted for simplicity of illustration, and a supporting floor surface diagrammatically shown.

In FIG. 1, the compactor-strapper of this invention is there generally indicated at 10 and comprises a frame 20, which in a sense also comprises the floor 30, part of which is shown in full lines, but mostly in dotted lines. The frame 20, comprises forward and rearward right hand angleiron vertical frame members 42 and 44, and also forward and rearward left hand vertical frame members 46, only one of which is seen in FIG. 1.

Between the two forward frame members, 42 and 46, and at the top thereof, there is a hydraulic cylinder support beam 480 attached to each frame member, 42 and 46, supporting a jaw controlling hydraulic cylinder C, fixed by a clevis assembly 482 to the beam 480, and fixed by a lower clevis assembly 484 to the outer end of an upper forward jaw 490. The jaw 490 is a moving jaw, pivoted at 492 about a horizontal axis.

Figure 2:
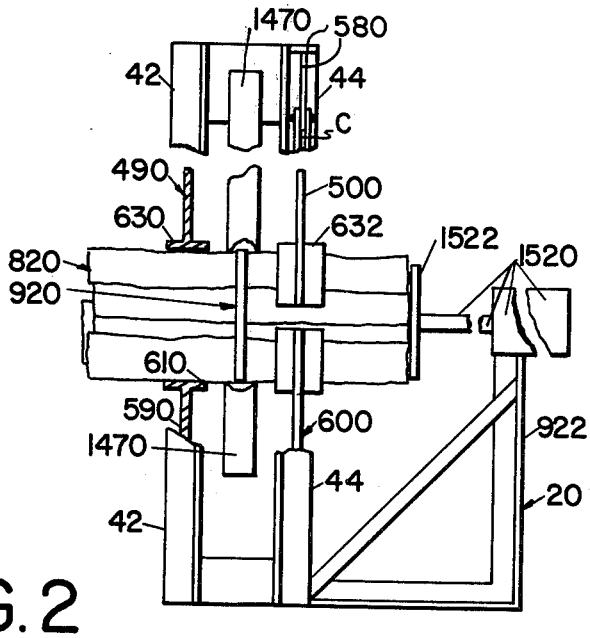
FIG. 2 is a sectional view taken along the line 2—2 of FIG. 1 approximately, the view being partially diagrammatic, portions of frame portions and jaws being broken away and other parts showing in section and the moving jaw cylinders being omitted, portions of a strapper yoke being broken away for showing a strap in place around a load of firewood, portions of an ejection plate operating cylinder being broken away to shorten it for easier showing, although its length is much longer to completely eject the firewood bundle.

The jaw 490 can be called a forward jaw and there is also a rearward jaw 500, spaced rearwardly from the forward jaw 490 and in alignment with the rear upright 44 and 46, only one of which is shown in the drawings, namely the upright 44 in FIG. 2. The rearward jaw 500 is of a similar construction as would be seen looking at it horizontally from its forward or rearward side and is controlled by a cylinder C disposed directly rearwardly from the forward cylinder C, the rearward cylinder C being connected to a rear hydraulic cylinder beam 580, directly rearward from the forward cylinder beam 480 but anchored to the rearward uprights 44 and 46 of the frame.

The moving jaws 490 and 500 move toward and away from forward and rearward fixed jaws 590 and 600, respectively, which can be seen in FIG. 2. The fixed jaws, 590 and 600, can also be called fixed lower jaws since they are preferably beneath the moving jaws, 490 and 500.

On the upper side of the lower jaws 590 and 60, are upwardly facing cradles or wider jaw portions 610, which are horizontally much thicker than lower parts of the jaws 590 and 600, the cradles 610 being of arcuate shape, particularly of the shape of a semi-circle as best seen in FIG. 1. The upper side of each cradle 610 is directly behind and parallel to the other cradle 610. The upper sides of the cradle 610 define the underside of a substantially cylindrical jaw cavity 620.

The upper jaws, 490 and 500, also have upper cradles, 630 and 632 on their lower sides respectively. The cradles 630 and 632 each having undersurfaces which are preferably semi-cylindrical, forming at times when the jaws are closed portions of the upppersides of the cavity 620, which itself is cylindrical, for making a substantially cylindrical compressed bundle of firewood.

There are times when the cavity 620 is desired to be of a different size. When that is the case, then the lower jaws, 590 and 600 are changed so as to be replaced by lower jaws which have cradles having larger cavity portions defined by larger lower cradles 610, not shown. To work therewith, the change in size of the capacity of the machine is made simple without removal of the cylinder C and their connection to the upper jaw 490 by simply making the upper jaws 490 and 500 of a segmental nature so that they have lower segments 702, of which the upper cradles, 630 and 632, respectivly, form parts, so that the lower forward and rearward segments 702, of the respective upper jaws, 490 and 500 can be disconected from the upper segments, 708, of the respective upper jaws 490 and 500, so that they can be replaced by other lower segments 702, which latter have upper cradles, 630 and 632 on their lower sides which have greater capacity to form the upper halves of a cylindrical configuration larger than the one formed by the cradles 610, 630 and 632 of FIG. 1 and of FIG. 2.

Removal of the lower segments 702 is made simple by the provision of tabs 760 welded to lower segment 702 and lapping across the upper segment 708 to which latter they are bolted by bolts 762 for easy on bolting and removal of the lower segment 702, as desired.

The lower jaws 590 and 600 are bolted to the framework in any suitable fashion such as, by bolts 780.

The lower sides of the lower jaws 590 are firmly and strongly supported by lower jaw supporting beams, 800, comprising forward and rearward lower jaw supporting beams, 800, which latter respectively extend between the forward upright frame members 42 and 46, and between rearward upright frame members, 44 and 46, and are fixed to the upright frme members respectively by welding 804, just as the cylinder beams 480 are welded to the upright frame members at 810 at their respective ends to the respective upright frame members, 42,44 and 46.

The strapping machine is shown in FIG. 1 and has a housing, 900, to which is attached a yoke, 1470, of the strapper, which is later described and which is adapted to completely surround the cavity 620 so that a strap coming from the yoke 1470 can be extended completely around cavity 620 so as to bind a bundle of firewood logs generally indicated at 820 in FIG. 3 while the bundle 820 is disposed in the cavity 620 and compressed by the jaws.

The strapper has its own special frame generally indicated at 902 in FIG. 1 which is completely independent of the remainder of the frame 20 of which it forms a part only in the sense that the two both rest on the floor 30, whereby the frame 902 of the strapper can be removed completely from the compactor 910 when desired and even moved far away provided it is disconnected from later described pneumatic connections to a later described pneumatic manifold and a later described timer-cycler.

The strapper S has a reel 914, mounted on it for delivering a strap 916 to the yoke 1470, so that the strap ultimately becomes bound tightly around the bundle 820 forming a strap loop at 920, seen in FIG. 2.

In FIG. 2 it can be seen that a rearwardly extending portion 922 of the frame 20 supports a later described ejector cylinder assembly 1520 having at its forward end and ejector plate 1522 dispose in a position to be rearwardly off the bundle 820 at times when the bundle 820 is rested in the cradles 610 and 630, the length of the cylinder 1520 being sufficient however, to push the ejector plate 522 forwardly at desired times sufficiently to completely eject the bundle 820 past the forward end of the forward-most cradles, 610 and 630.

In FIG. 1, a hydraulic pump 1750, is shown above a hydraulic reservoir 1754, fixed to the uprights, 42 and 44.

In FIG. 1, a cycle starting button 1400 can be seen mounted in a housing 1402 in which latter is also disposed an emergency stop button 1600, later described.

Figure 3:
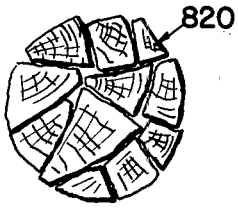
FIG. 3 is an end view of a firewood bundle as it might be arranged in the machine after compaction and preparatory to strapping.

Referring to FIG. 3, a hydraulic-pneumatic circuit diagram is there shown, in which the sequence of operation is now described. First of all we presume that the jaws are open and that the operator has loaded the firewood compartment with sufficient firewood for a bundle and is desiring to close the jaws as the next step.

In FIG. 3, the operator presses the cycle starting button 1400 of a three-way air walve, called a cycle starting valve, generally indicated at 1410, receiving air under pressure from a source 1420, whereby the pressing of the cycle starting button 1400 causes air to pass through line 1424 to an air timer-cycler, generally indicated at 1430, which then delivers signal air through line 1438 out to a four-way hydraulic valve 1440, called a hydraulic-pneumatic hydraulic cylinder control valve, which receives hydraulic through line 1450, whereby the pressure from the line 1438 will actuate the valve 1440 so as to deliver hydraulic fluid through a line 1452, having branches 1454 leading to each of the two hydraulic cylinder assemblies C for causing them to expand to close the moveable jaws against the firewood bundle.

While the hydraulic cylinders C are still holding the moveable jaw in closed position, the air timer-cycler then sends an air signal through a line 1460 to the strapping machine S, causing the strapper S to pull the strap out of a strapper holder 1470 and tension it around a bundle and bind the ends of the strap together.

Next, the air timer-cycler 1430 removes the pressure signal from the line 1438 causing the four-way hydraulic valve 1440 to operate automatically by spring pressure so that the hydraulic fluid flowing into line 1452 ceases; and the hydraulic fluid then flows into the line 1480 having branches 1482 and 1484 into respective jaw actuation cylinders C. The cylinders C then open the jaws by their retraction and the moveable jaws remain open because of continous pressure through the line 1480 during which time the air-timer cycler 1430 sends a signal through line 1490 to a four-way ejector control valve 1500, which latter receives pressure from an air pressure source 1502, which is the same source as earlier mentioned at 1420.

The four-way ejector control valve 1500 then sends air pressure through a line 1512 to an air cylinder assembly 1520 connected to an ejector plate 1522 which hits the back side of the bundle pushing the bundle out of the compactor. The cylinder assembly 1500 is fixed to a frame member 1532 of the frame of the machine.

The ejector plate 1522 is disposed in a position on the back side of the machine with its forward surface 1533 facing the position of a bundle indicated by the dotted lines 1540 in FIG. 3, the length of stroke of the cylinder assembly 1520 being sufficient for pushing the bundle 1540 out of the bundle compartment of the jaws and out through the forward side of the machine. The operator then catches the bundle suitabley and stacks it.

An emergency stop button is shown at 1600 and it actuates an emergency stop air valve 1602 receiving air under pressure from the common source 1420 whereby pressing of the button 1600 will send the signal through the line 1610 to the air timer-cycler causing the air timer-cycler to return to its rest position whereby all cycling is suddenly stopped.

In FIG. 3 an air manifold is shown at 1700 receiving air through an air filter 1702 and the manifold 1700 delivers air through an outlet line 1420 which has been mentioned before as a source of air. The manifold 1700 is fixed to the frame of the machine. The outlet line 1420 also delivers air for the pneumatic control of the strapper S as shown.

The hydraulic fluid available at the line 1450 is provided by an electric pump-motor 1750 receiving fluid through a line 1752 from a reservoir 1754 and the pump-motor 1750 delivers fluid through a line 1758 to the line 1450, although a by-pass line 1760 is provided having a spring loaded pressure relief valve 1770 which controls the hydraulic pressure at the jaws so that it is sufficient but not excessive.

The three-way air valve 1410 receives air under pressure from the source 1420 which is the air manifold 1700. The three-way air valve 1410 has an outlet port, not shown, for exhausting air and which is not shown because that is the conventional way of circuitry symbols.

The reason the air-timer cycler stops all cycling when it returns to its rest position is because in its rest position the air valves, not shown, on the air timer-cycler 1430, cause the two lines 1438 and 1490 to be depressurized. When this happens, the four-way hydraulic valve 1440 moves to a position, automatically because of a spring therein, such that the flow becomes in the direction of an arrow in the line 1480, for causing the cylinders C to retract in the direction of the arrows.

And when the pressure in the line 1490 ceases, which occurs in the timing cycle after pressure in the line 1438 and retraction upward of the cylinders to open the jaws, then the ceasing of pressure in the line 1490 will cause the spring of the valve 1500 to cause pneumatic pressure to travel through a line 1670 to cause the ejector plate 1522 to retract rearwardly so that it is prepared to be out of the way for the reception of the next bundle to be compacted.

The timer-cycler 1430 is set to retract the ejector plate 1522 rearwardly almost instantly after it has first caused it to finish moving out for bundle ejection.

The sequence made possible by the timer cycler 1430 is first the compression of the firewood by expansion of the hydraulic cylinders C, because of pressure passing through the line 1438 to the hydraulic cylinder control valve 1440.

At the peak of compression of the firewood load the timer-cycler 1430 sends a signal through the line 1460 to the strapper S which initiates strapping and then seals a strap about the firewood in the customary manner of operation of automatic strappers.

As soon as the strap has been applied, the pressure signal is removed from the hydraulic cylinder control valve 1440 allowing it to deliver pressure to the cylinders for opening the jaws.

The timer-cycler 1430 is physically timed so that after the jaws have opened than a momentary signal is sent from the timer-cycler through the line 1490 to the ejector control valve 1500, causing expansion of the pneumatic cylinder 1520 for ejecting the firewood. Thereby the machine is placed in rest position again ready for a new load of firewood.

The strapper S and its yoke 1470 can easily be removed from the machine since it has no connection thereto with the exception of sharing a common supporting surface, namely, the floor, which latter thereby in effect becomes a part of the frame of the entire machine, meaning the compactor and the strapper in its entirety. The only connection between the strapper and the remainder of the machine is the pneumatic line 1460. The strapper has its own air supply line 1420 from the manifold 1700.

The air timer-cycler 1430 can be of the type described in my co-pending United States patent application titled: STRAPPER FEED CONVEYOR, filed June 8, 1977; inventor: B. Carson Russell, Ser. No. 804,319.

Figure 4:
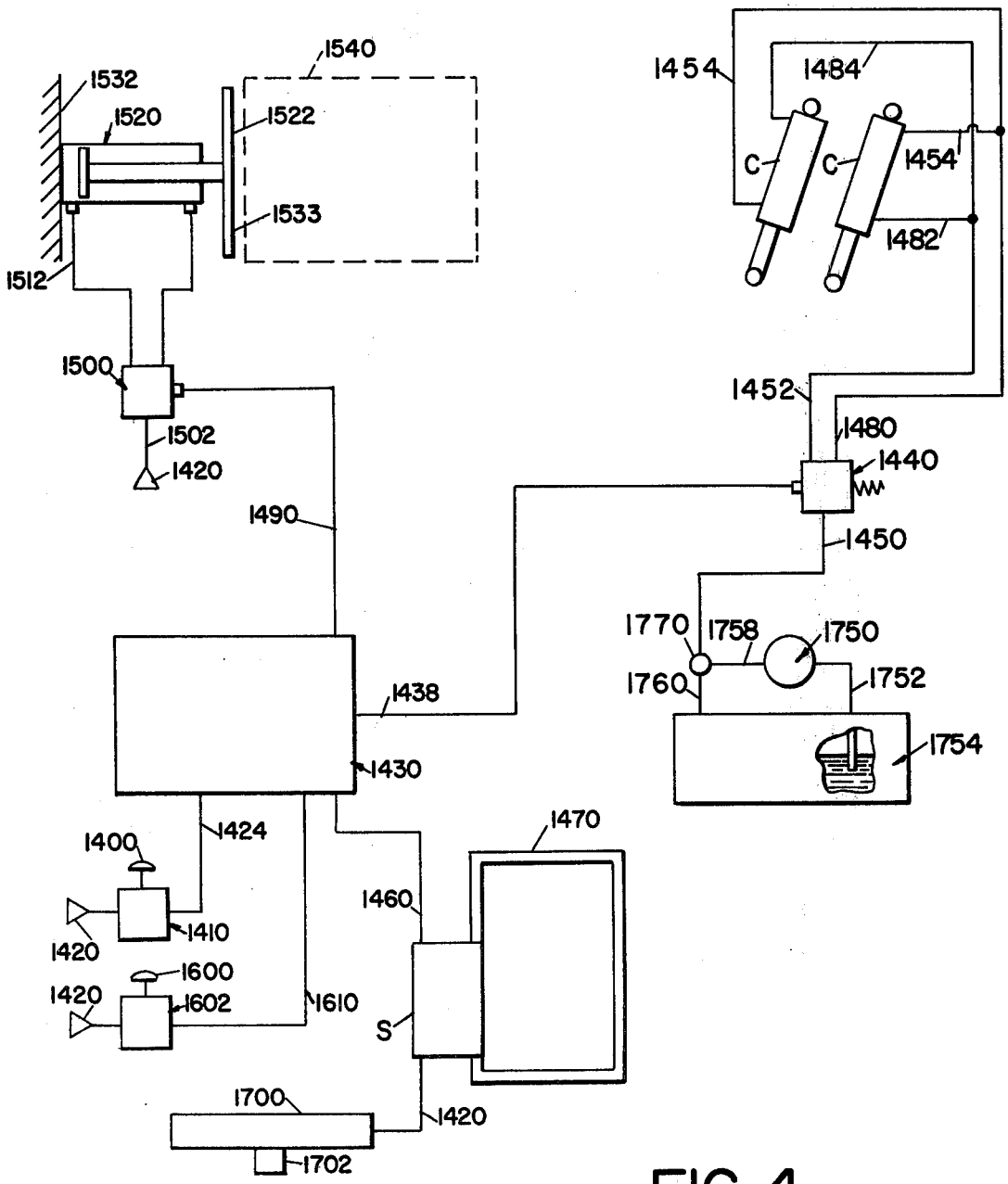
FIG. 4 is a circuit diagram of the pneumatic circuit of this invention for coordinating and synchronizing the compactor jaws, the automatic strapper and the bundle ejector utilizing an air timer-cycler.

The timer-cycler 1430 can also be a common prior art rotary timer-cycler using rotating cams doing the same controlling of air pressure lines as described, but by means of air valves operated by cams, all cams and valves being synchronized to accomplish the same sequence above described. The timer-cycler 1430 would not be called an air timer-cycler when the latter type of a timer-cycler 1430 is used, but the general name, timer-cycler, would still apply to all elements diagrammatically designated in FIG. 4 in the rectangular symbol 1430.

I claim:

1. A compactor-strapper comprising: a frame having a work-reception chamber therein, forward and rearward fixed jaws rigidly attached to said frame on one side of said chamber, forward and rearward moveable jaws attached to said frame on an opposite side of said chamber from said fixed jaws, said moveable jaws moving toward and away from said forward and rearward fixed jaws respectively for compaction and release, said moveable jaws moving independently to adjust to uneven work pieces in said cavity, forward and rearward independent actuators attached to said frame and actuating said forward and rearward moveable jaws respectively for causing said movements toward and away from said fixed jaws, said fixed jaws and said moveable jaws each having cavities therein defining walls of said chamber, said cavities of said front and rear fixed jaws substantially facing said cavities respectively of said front and rear jaws, said forward and rearward jaws being spaced apart for providing a strapping space therebetween, and a strapping machine mounted on said frame and having strap applying portions (arranged around) at said strapping space and applying straps onto materials disposed in said chamber.

2. The compactor-strapper of claim 1 having said forward and rearward moveable jaws each being hingedly attached to said frame at one end thereof and at a side of said chamber whereby the other end of each of said moveable jaws is free to swing toward and away from a respective fixed jaw.

3. The compactor-strapper of claim 2 having said independent actuators being forward and rearward hydraulic cylinders respectively pivotally attached to and between parts of said frame and parts of said moveable jaws respectively.

4. The compactor-strapper of claim 1 having said fixed and moveable jaws provided with removeable and replaceable insert portions respectively each of which latter have one of said cavities therein respectively whereby the size of said chamber is variable.

5. The compactor-strapper of claim 1 having a bundle ejecting assembly comprising an ejection hydraulic cylinder assembly mounted on said frame and having a work piece pushing portion which moves upon change in length of said ejection hydraulic cylinder assembly causing said pushing portion to push work pieces out of said chamber and moving in an opposite direction for retraction of said pushing portion into a position for being clear of said chamber so that unstrapped work pieces can be placed in said chamber without interference from said ejection hydraulic cylinder assembly.

* * * * *